US006099075A

United States Patent [19]

Watkins

[11] Patent Number: 6,099,075

[45] Date of Patent: Aug. 8, 2000

[54] SEATING ARRANGEMENT

[75] Inventor: Mervyn M. Watkins, Rancho Palos Verdes, Calif.

[73] Assignee: Convaid Products, Inc., Torrance, Calif.

[21] Appl. No.: 08/995,117

[22] Filed: Dec. 19, 1997

[51] Int. Cl.[7] ..... A47C 3/025

[52] U.S. Cl. ..... 297/284.1; 297/452.29

[58] Field of Search ..... 297/284.4, 284.1, 297/284.3, 452.63, 452.3, 452.29, 452.33

[56] References Cited

U.S. PATENT DOCUMENTS 3,554,599 1/1971 Pietschmann .
3,990,742 11/1976 Glass et al. .
4,350,388 9/1982 Weiner .
4,452,485 6/1984 Schuster .
4,916,765 4/1990 Castronovo, Jr. .
5,685,606 11/1997 Lance .

FOREIGN PATENT DOCUMENTS 8500736 2/1985 WIPO .

*Primary Examiner*—Milton Nelson, Jr.
*Attorney, Agent, or Firm*—Don Finkelstein

[57] ABSTRACT

A seating arrangement having a flexible back and/or seat portion with retaining type pockets thereon for removably retaining at least one bendable rigid support in a predetermined orientation.

12 Claims, 3 Drawing Sheets

FIG. 1
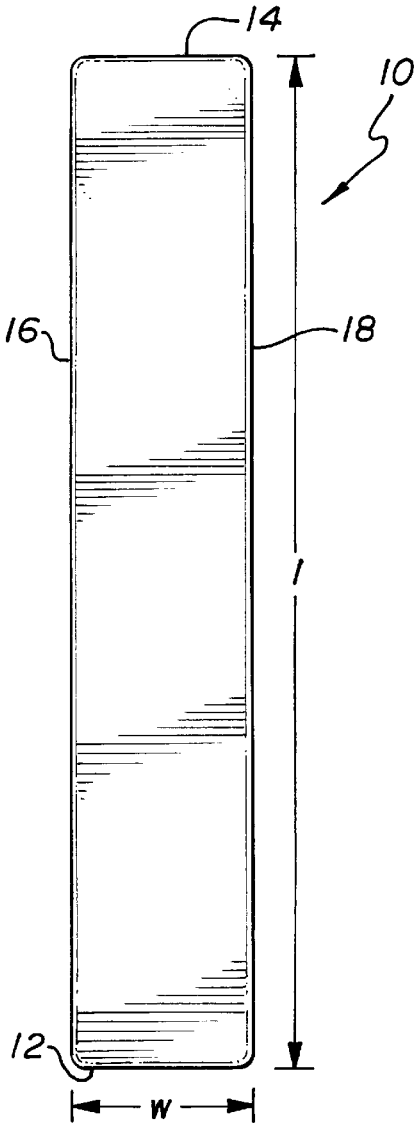
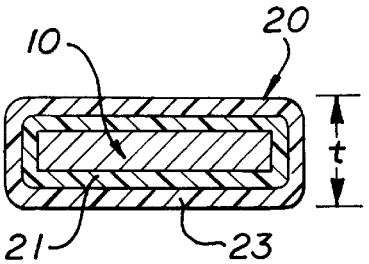
FIG. 3
FIG. 2a
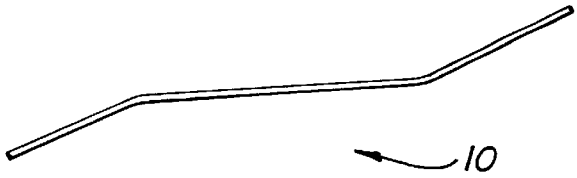
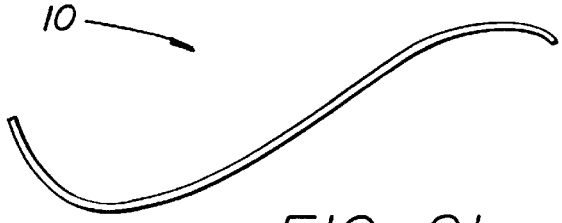
FIG. 2b
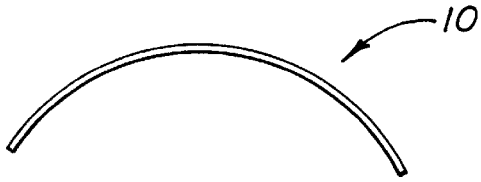
FIG. 2c
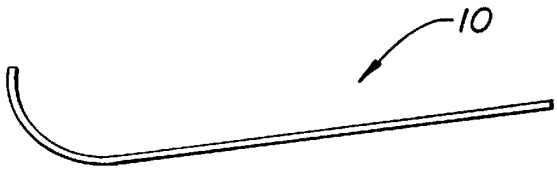
FIG. 2d
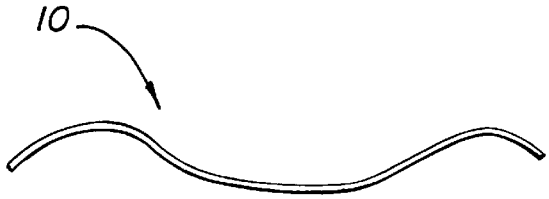
FIG. 2e FIG. 4
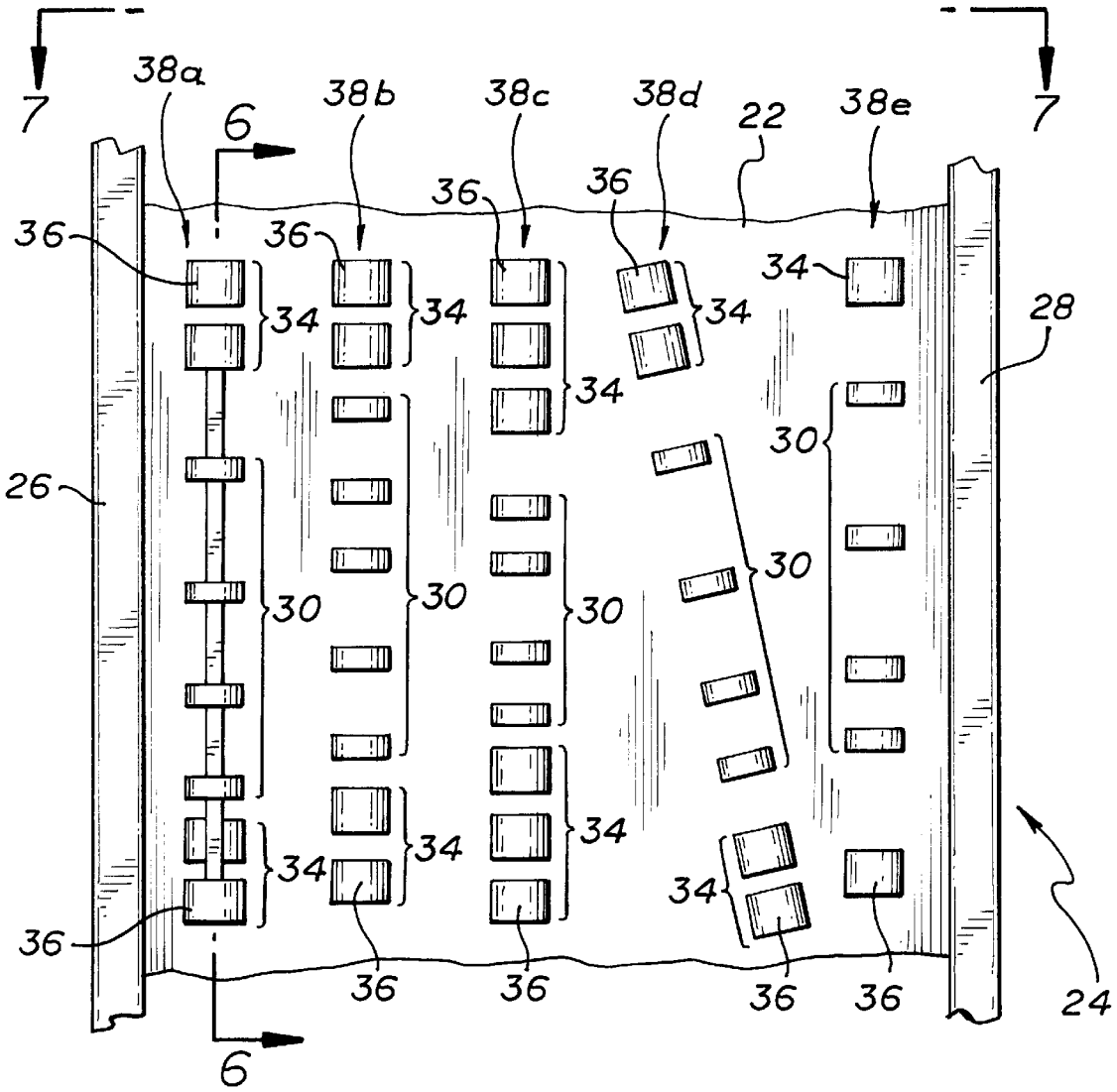
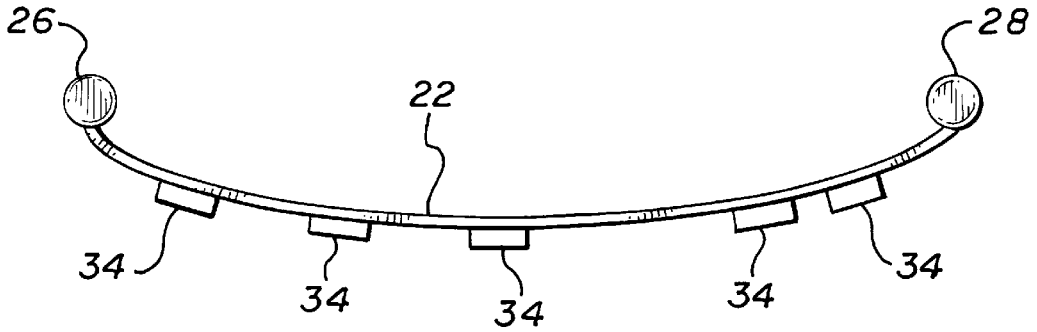
FIG. 7

FIG. 5
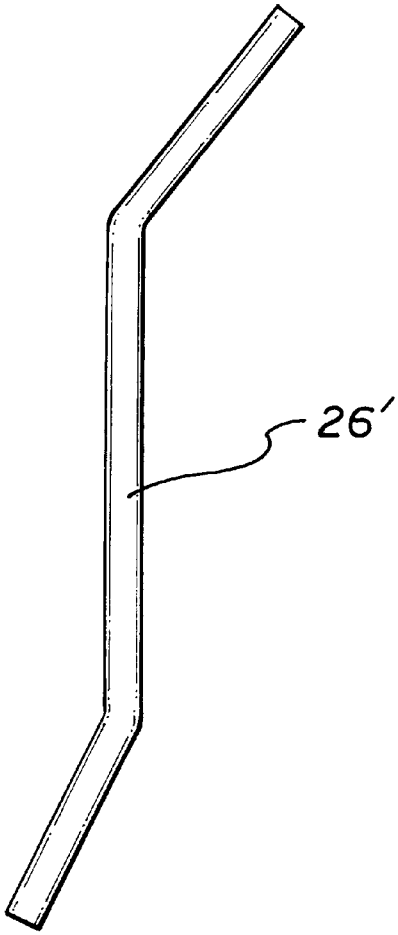
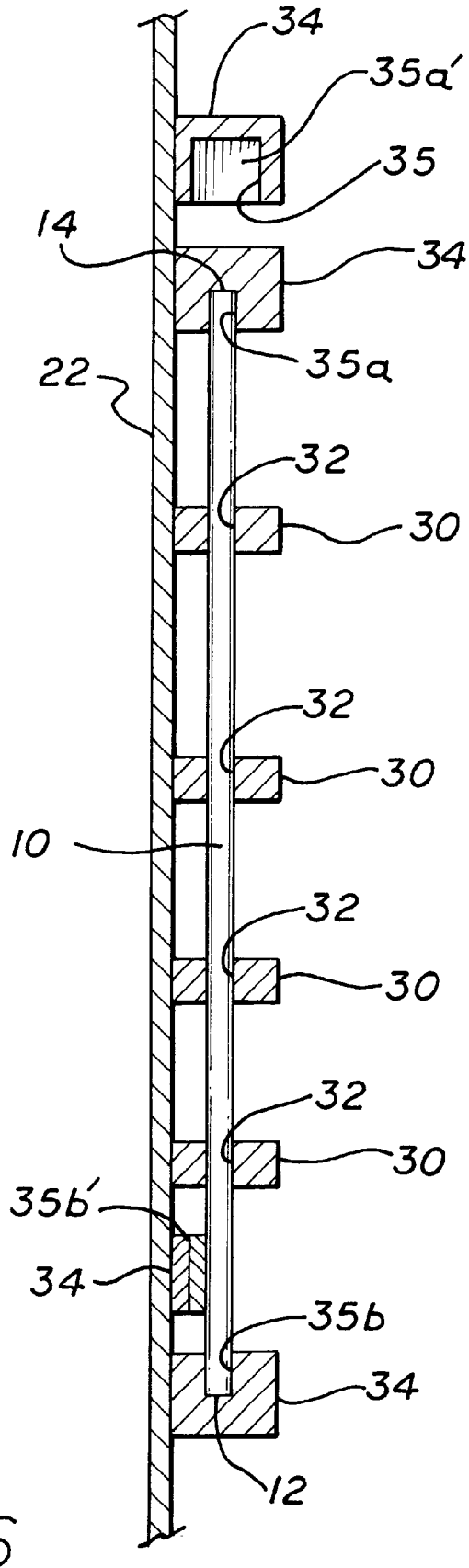
FIG. 6

SEATING ARRANGEMENT

BACKGROUND OF THE INVENTION

1. Field of the Invention

This invention relates to the seating art and more particularly to a seating arrangement having a flexible back portion and/or seat portion into which one or more bendable, rigid support members may be inserted to provide a rigid support for portions of the back, buttocks and/or thighs of the user.

2. Description of the Prior Art

In many seating arrangements heretofore utilized in various applications there have been provided flexible back and/or seat portions. Such applications include many mobile strollers, lawn and patio furniture, and the like. In some of such seating arrangements provisions are made for adjusting the contours of the back and/or seat to accommodate the back configuration an/or the hip-buttock-thigh configuration of persons suffering from various deformities of the body. In my prior U.S. patent applications, Ser. No. 08/417,738 and Ser. No. 08/946,302, I have described various stroller configurations having flexible back and/or seat portions. The flexible back and/or seat portions may be fabricated in some applications from a plurality of bands or straps of cloth, plastic, or other woven or unwoven materials secured to rigid side frames. Such bands or straps can be individually adjusted so as to vary the amount of slack between the rigid side frames to allow for individual contouring thereof to conform to the body shape of the user. Alternatively, in other applications, a sheet of fabric of cloth, plastic or other flexible material is coupled between the side frames and generally there is some amount of slack between the side frames. In both such applications, the flexible nature of the seat and back portion allows the seating arrangement to be folded for convenient storage which is a desired feature in many strollers or other mobile seating applications.

Lawn and patio furniture used in the past often incorporated flexible back and/or seat portions fabricated from cloth, plastic or the like and either in a single sheet between two rigid side frames or in bands or straps between two rigid side frames.

Such prior art seating arrangements incorporating the flexible back and/or seat portions provided comparatively light weight and/or foldable characteristics, they did not provide all characteristics often desired in seating arrangements. That is, the flexible nature of the back and/or seat portions dial not provide for a rigid support of certain portions of the body of the user such as, for example, the lumbar portion of the back. In those applications for persons having some degree of physical deformation, it is often desired to provide a more rigid support to the contours of the body than is available by adjusting the tension in the straps or bands forming the back or seat. There have heretofore been utilized a rigid back and/or seat portion of a seating arrangement for such persons suffering from physical deformities. This was achieved by making a casting corresponding to the body contours of the person. Such a casting was applicable to only one person and was not adaptable to changes in the contour of the person over time. Also, such castings are comparatively expensive and often were heavy in weight.

The contours of those persons suffering from a physical deformity often change with time and, of course, vary from person to person. Thus, rigid supports to be utilized in such seating applications having flexible back and/or seat portions are desired to be bendable to various contours to accommodate the various contours of persons who will utilize the seating arrangement but remain rigid in each contour to which they may be bent to provide support to the person during use. The bendable nature of the supports allows the same rigid support member to be bent to accommodate not only the desired contours of the body of the user at any one time but also to allow for change in the contour of the rigid support member to accommodate changes in the contour of the body of the user.

Further, it is also often desired to install such bendable rigid support members in the flexible back and/or seat portions of seating arrangements in various orientations with respect to the rigid side frames. That is, they may be desired to be installed parallel to the side frames, perpendicular to the side frames or at some other angular orientation. Such orientation will often depend on the particular contour that the rigid support member is to accommodate.

Prior art seating arrangements have not been able to provide the above desired features. Thus, there has long been a need for a seating arrangement of the type having a flexible back and/or seat portion also having provisions for selective insertion of bendable, rigid support members therein to accommodate the body contours of the user and adaptable to be bent into shapes providing such rigid support as may be desired for all persons as well as selective contouring to accommodate those with some physical deformity.

SUMMARY OF THE INVENTION

Accordingly, it is an object of the present invention to provide an improved seating arrangement with selective rigid support for the back and/or hip-thigh-buttock region of the user.

It is another object of the present invention to provide a seating arrangement with flexible back and/or seat portions which can receive selective rigid support members at preselected locations therein.

It is another object of the present invention to provide a seating arrangement with flexible back and/or seat portions with rigid support members bendable to accommodate the contours of selective portions of the user's body.

It is still another object of the present invention to provide a seating arrangement with flexible back and/or seat portions in which one or more bendable rigid support members may be inserted at preselected locations thereon.

The above, and other objects of the present invention are achieved, according to a preferred embodiment thereof, in a seating arrangement having a flexible back and/or seat portion. For convenience of description, the invention herein is described as utilized in the back portion of a seating arrangement having a flexible back portion comprised of a single sheet of a flexible material. Those skilled in the art can easily determine the technique for adapting the invention for utilization in the flexible seat portion of a seating arrangement. Further, the invention may be utilized in the back and/or seat portion of seating arrangements in which there is provided a plurality of straps or bands extending in a one or two dimensional matrix. In all such arrangements, the flexible portions extend between spaced apart rigid side frames. Further, there is a predetermined "slack" to the flexible seat and/or back portion in order to accommodate the change in contour provided by the present invention.

The flexible portion is provided with retention structure for the bendable rigid support members. Such retention structure may comprise a first plurality of loops coupled in a preselected spaced apart, aligned array. The loops may be flexible material defining a rigid support member receiving aperture with the flexible back portion. The preselected array may be parallel to the rigid side frames to which the flexible portion is attached, perpendicular thereto or at any other desired angular relationship with respect thereto. The retention structure may also incorporate one or more first pocket forming flaps coupled to the flexible back portion in aligned relationship to the plurality of loops and at locations for accommodating the ends of a rigid support member. As many desired arrays of loops and pocket forming flaps may be provided on the flexible back to allow for contouring to meet particular requirements of the uses. Several first pocket forming flaps may be mounted on the flexible back in close relationship to accommodate the end of a rigid support member for the condition of greater or less bend placed thereon. One or more second pocket members may be place in spaced relationship to the first pocket member for retention of the other end of the bendable rigid support members. The second pocket forming flaps face have the open end thereof facing the open end of the first pocket forming flaps.

One or more bendable rigid support members are insertable in the apertures formed by the loops and having one or both ends thereof in a pocket formed by the pocket forming flaps. Each bendable rigid support member may be on the order of 18 inches long and 1 inch wide with a thickness on the order of ¼ inch, though larger or smaller dimensions may be utilized for particular applications. Each bendable rigid support member may be fabricated from nylon, aluminum, other bendable metal, plastic such as ABS, polypropylene, or other suitable plastic. The bendable rigid support member is preferably flat though oval, round or other cross section shapes may be used. The bendable rigid support member may be coated with one or more coats of various materials for particular applications. For example, a coating of polyurethane foam may be applied for comfort to the user and a thin coat of any desired film plastic applied over the foam for protection. The bendable rigid support member is capable of being manually bent to desired configurations and, preferably, repeatedly manually bendable into desired configurations.

In the use of the present invention, the contours of the user's body to which the rigid support is to be conformed is first determined. This may be done by visual inspection of the body contours or by Any other, more sophisticated technique. the bendable rigid support member is the bent to the desired contour and matched to the desired body contour of the user. When the contour of the bendable rigid support member is matched to the body contour of the user, the bendable rigid support member is inserted in the bendable rigid support member receiving apertures defined by the loops and at least one end may be positioned in a pocket formed by then pocket forming flaps. In some applications it may be desired to have both ends of the rigid support member in a pocket and in other applications only one end thereof positioned in such a pocket. The pockets tend to maintain the bendable rigid support members in the desired predetermined linear array defined by the loops. Several such bendable rigid support members may be utilized on any one flexible back portion and in any desired array or pattern thereof as determined by the arrays defined by the loops. The "slack" in the flexible back portion allows the contouring of the back portion to the contours determined by the bendable rigid support members.

For the condition of a change in the body contours of the person using the seating arrangement, the bendable rigid support member may be removed from the seating arrangement and bent to the new contours and then reinserted into the back portion. This may be repeated as many times as is considered necessary.

BRIEF DESCRIPTION OF THE DRAWING

The above and other embodiments of the present invention are more fully understood from the following detailed description taken together with the accompanying drawing wherein similar reference characters refer to similar elements and in which:

FIG. 1 illustrates a bendable rigid support member useful in the practice of the present invention;

FIGS. 2*a* through 2*e* illustrate some of the configurations into which the bendable rigid support member may be bent;

FIG. 3 is a sectional view of another bendable rigid support member useful in the practice of the present invention;

FIG. 4 is a view of the flexible back portion of a seating arrangement which may accommodate one or more bendable rigid support members;

FIG. 5 illustrates a side frame of a back portion of a seating arrangement useful in the practice of the present invention;

FIG. 6 is a sectional view along the line 6—6 of FIG. 4;

FIG. 7 is a view along the line 7—7 of FIG. 4;

DESCRIPTION OF THE PREFERRED EMBODIMENTS

Referring now to the drawing, there is illustrated in FIG. 1 a bendable rigid support member 10 useful in the practice of the present invention. The bendable rigid support member 10 has a length "l" between a first end 12 and second end 14 and has a width "w" between side edges 16 and 18. The length "l" may be on the order of 18 inches to 20 inches or so, or any other length desired for particular applications. The width "w" may be on the order of ½ inch to 2 inches or so, or any other width desired for particular applications. The thickness "t" (FIG. 3) may be on the order of ¼ inch to ⅜ inch or greater or less as required for particular applications. The bendable rigid support member 10 is shown in FIG. 1 in a flat condition: that is, before being bent into a desired contour. The bendable rigid support member 10 may be fabricated from nylon, aluminum, plastic such as ABS, polypropylene, or the like, or any other desired material suitable for the purpose. The bendable rigid support member 10 preferably may be repeatedly bent into various configurations without damage or permanent deformation thereto.

FIG. 2*a* through 2*e* illustrate some of the configurations into which the bendable rigid support member 10 may be configured as desired for particular applications. The configurations illustrated in FIGS. 2*a* through 2*e* are only examples of the configurations which may be desired in the practice of the present invention. Thus, FIG. 2*a* illustrates the configuration for a lumbar support. FIG. 2*b* illustrates a reverse curve configuration and FIGS. 2*c* through 2*e* illustrate other configurations.

In some applications it may be desirable to cushion the bendable rigid support member for the comfort of the user. FIG. 3 illustrates a cross section of a cushioned bendable rigid support member 20 in which the bendable rigid support member 10 is provided as the core and a first layer 21 of foam such as polyurethane foam is applied to provide a preselected softness to the cushioned bendable rigid support member 20. If desired, a further coating of one or more thin layers 23 of a suitable plastic material may be applied to the foam layer to resist abrasion or damage thereto.

FIG. 4 illustrates a section of a flexible back portion 22 of a seating arrangement 24 useful in the practice of the present invention. The flexible back portion 22 extends between a pair of spaced apart rigid side frames 26 and 28. The rigid side frames 26 and 28 may be linear or may be bent into a predetermined configuration to provide greater comfort than is achieved by a more planar flexible back portion 22. FIG. 5 illustrates a side frame 26' of a seating arrangement which is contoured to provide additional comfort to the user. The present invention may be utilized in conjunction with any desired side frame configuration. In all embodiments of the present invention, there is a preselected slack in the flexible back portion extending between the side frames 26 and 28 in order to accommodate the contours imposed thereon by the bendable rigid support members of the present invention.

As noted above, for purposes of clarity of description, the present invention is described herein as applied in the back of a seating arrangement having a flexible back portion the principles of the present invention are also applicable to a flexible seat portion of a seating arrangement as may be required. further, while the invention is described in conjunction with a sheet like flexible back portion, the present invention may also be incorporated in seating arrangements wherein the flexible back portion and/or seat portion is comprised of a plurality of bands or straps extending between the rigid side frames in a one or two dimensional matrix.

As shown on FIG. 4, the flexible back portion 22 has a plurality of loops 30 coupled thereto by, for example sewing, bonding by adhesive, or any other method. The loops are arranged in a plurality of aligned spaced apart linear arrays and each loop 30 defines a bendable rigid support member accepting aperture 32 with the flexible back portion 22. A plurality of pocket defining flaps 34 are also coupled to the flexible back portion 22 and are positioned in alignment with the plurality of aligned space apart linear arrays of loops 30 at the position where the ends of a bendable rigid support member may be expected to be. Since the location of the ends of the bendable rigid support members may vary as the degree of curvature therein is varied, in some applications of the present invention it may be desirable to incorporate several pocket defining flaps 34 in close proximity to each other at the desired end locations as illustrated at 36. Each of the pocket defining flaps 34 define a bendable rigid support member end accepting pocket 35 with the flexible back portion 22 for accepting an end of a bendable rigid support member therein. The loops 30 and pocket defining flaps 34 are flexible and may, if desired, be formed of the same material as the flexible back portion 22, or other flexible materials may be utilized.

As shown on FIGS. 4, 5, 6 and 7 a bendable rigid support member such as the bendable rigid support member 10 or 20 is inserted in the apertures 32 formed by the loops 30 in a first of the plurality of aligned arrays 38*a* thereof and at least the first end 12 thereof is preferably inserted into one of the pockets 35. For purposes of illustration the bendable rigid support member 10 is shown inserted in array 38*a*. in a flat or not bent condition. the bendable rigid support member 10 may be bent into any of the configurations shown in FIG. 2*a* through 2*e* or in other configurations as desired for particular applications. In some applications both the first end 12 and the second end 14 of the bendable rigid support member 10 are inserted into a pocket 35 while in other applications only the first end 12 is inserted into a pocket 35. If desired, a bendable rigid support member 10 may be inserted into any of the other of the plurality of aligned arrays 38*b*, 38*c*, 38*d* or 38*e*. While five of such arrays are illustrated, more or less than five may be used as desired in particular applications.

FIG. 6 is a sectional view taken along the line 6—6 of FIG. 4 and illustrates the placement of the bendable rigid support member 10 in the apertures 32 and in the pockets 35*a* and 35*b*. The other pockets at 35*a'* as vell as at 35*b'* are provided for the condition of the bendable rigid support member 10 being bent into configurations which shorten or lengthen the projected separation between the ends 12 and 14.

FIG. 7 is a view along the line 7—7 of FIG. 4 and illustrates the desired "slack" of the flexible back portion 22 so that the contour of the bendable rigid support member 10 may be imparted to the flexible back portion 22.

This concludes the description of the preferred embodiment of the present invention. those skilled in the art may find many variations and adaptations of the present invention and the appended claims are intended to cover all such variations and adaptations falling within then true scope and spirit thereof.

What is claimed is:

1. An improved seating arrangement comprising, in combination:

a seating arrangement having a back section and said back section having a pair of spaced apart rigid side frame members, and said back section further comprising a flexible back portion extending between and coupled to said pair of spaced apart rigid side frame members and having a predetermined slack length therebetween;

a plurality of flexible loops coupled to said flexible back portion in a predetermined spaced array defining a plurality of linear arrays of said loops in a predetermined angular relationship to said pair of rigid side frame members, and each of said loops defining a bendable rigid support member accepting aperture with said flexible back portion;

a plurality of flexible pocket defining flaps coupled to said flexible back portion and each of said flexible pocket defining flaps defining a bendable rigid support member end receiving pocket with said flexible back portion;

a first bendable rigid support member having a first end and a second end and bent into a first predetermined configuration inserted into said bendable rigid support member accepting apertures in a first of said linear arrays of said loops, and said first bendable rigid support member having said first end inserted into a first of said plurality of bendable rigid support member end receiving pockets.

2. The arrangement defined in claim 1 wherein:

at least one of said plurality of linear arrays of said loops is substantially parallel to said pair of rigid side frame members.

3. The arrangement defined in claim 1 and further comprising:

at least one additional flexible pocket defining flap coupled to said flexible back portion in close proximity to said first of said plurality of bendable rigid support member end receiving pockets.

4. The arrangement defined in claim 1 wherein:

at least one other of said plurality of linear arrays of said loops is at a predetermined angle to said pair of rigid side frame members which is different from the predetermined angular relationship of at least one other of said plurality of linear arrays of said loops.

5. The arrangement defined in claim 1 wherein:

said second end of said first bendable rigid support member inserted into a second of said plurality of bendable rigid support member end receiving pockets and spaced from said first of said plurality of said bendable rigid support member end receiving pockets.

6. The arrangement defined in claim 5 and further comprising:

at least one additional flexible pocket defining flap coupled to said flexible back portion in close proximity to said second of said plurality of bendable rigid support member end receiving pockets.

7. The arrangement defined in claim 5 and further comprising:

at least one additional flexible pocket defining flap coupled to said flexible back portion in close proximity to said first of said plurality of bendable rigid support member end receiving pockets; and at least one additional flexible pocket defining flap coupled to said flexible back portion in close proximity to said second of said plurality of bendable rigid support member end receiving pockets.

8. The arrangement defined in claim 1 and further comprising:

a second bendable rigid support member having a first end and a second end and bent into a second predetermined configuration inserted into said bendable rigid support member accepting apertures in a second of said linear arrays of said loops, and said second bendable rigid support member having said first end inserted into a third of said plurality of bendable rigid support member end receiving pockets.

9. The arrangement defined in claim 8 and further comprising:

said second end of said second bendable rigid support member inserted into a fourth of said plurality of bendable rigid support member end receiving pockets and spaced from said third of said plurality of said bendable rigid support member end receiving pockets.

10. The arrangement defined in claim 9 wherein:

said first bendable rigid support member is substantially parallel to said second bendable rigid support member.

11. The arrangement defined in claim 9 wherein:

said first bendable rigid support member is at a preselected angle to said second bendable rigid support member.

12. The arrangement defined in claim 11 and further comprising:

at least one additional flexible pocket defining flap coupled to said flexible back portion in close proximity to each of said first, said second, said third and said fourth of said plurality of bendable rigid support member end receiving pockets.

* * * * *